United States Patent [19]

Kühnert

[11] 4,120,178

[45] Oct. 17, 1978

[54] KNITTING MACHINE

[75] Inventor: Gottfried Kühnert, Aalen, Germany

[73] Assignee: Universal Maschinenfabrik Dr. Rudolf Schieber KG, Westhausen, Germany

[21] Appl. No.: 839,472

[22] Filed: Oct. 4, 1977

Related U.S. Application Data

[63] Continuation-in-part of Ser. No. 665,202, Mar. 9, 1976, abandoned.

[30] Foreign Application Priority Data

Mar. 13, 1975 [DE] Fed. Rep. of Germany ..... 2511086

[51] Int. Cl.[2] ..... D04B 7/06

[52] U.S. Cl. ..... 66/63

[58] Field of Search ..... 66/60–78

[56] References Cited

U.S. PATENT DOCUMENTS 750,052 1/1904 Greaud ..... 66/63

*Primary Examiner*—Ronald Feldbaum

*Attorney, Agent, or Firm*—Sughrue, Rothwell, Mion, Zinn and Macpeak

[57] ABSTRACT

A double flat-bed knitting machine comprises four needle beds disposed in two mutually opposed pairs which are themselves disposed each in two mutually bisecting planes. A slide carrying cam means is arranged for actuating the needles of the four needle beds, and the needles are double-headed tongue needles. The machine further comprises transfer plates in the needle beds remote from a knitware take-off point.

3 Claims, 28 Drawing Figures

RIGHT/RIGHT KNITTED CIRCULAR PRODUCT ON A

DOUBLE-LEFT-LEFT-V-BED-STRAIGHT AND CIRCULAR KNITTING MACHINE.

LEFT/LEFT KNITTED CIRCULAR PRODUCT ON A
DOUBLE LEFT-LEFT-V-BED STRAIGHT AND CIRCULAR KNITTING MACHINE

KNITTING MACHINE

CROSS REFERENCE TO RELATED APPLICATION

This is a Continuation-In-Part application based on application Ser. No. 665,202 filed Mar. 9, 1976 entitled "Straight and Circular Knitting Machine", now abandoned.

BACKGROUND OF THE INVENTION

The invention relates to a knitting machine with four oppositely disposed needle beds and a slide carrying cams for actuating all the needles, the needle beds being disposed in mutually bisecting planes, and being provided with double-headed needles and associated plates for moving the needles.

In a known knitting machine of this kind (U.S. Pat. Specification No. 1,797,436), the double-headed needles are of the pointed type. For the purpose of pressing in the needle heads it is necessary to provide pressure plates which occupy considerable space in the zone where knitting occurs and the production of even simple patterns requires complicated means for controlling the pressure plates associated with the various needles.

SUMMARY OF THE PRESENT INVENTION

The object of the present invention is to provide a simplified form of machine of this kind and to render it suitable for the production of patterns.

The present invention provides a knitting machine comprising four needle beds disposed in two mutually opposed pairs, and a slide carrying cam means for actuating the needles in the needle beds, said two pairs of needle beds being disposed each in one of two mutually bisecting planes, said needles being double-headed tongue needles movable by associated plate means, and said machine further comprising transfer plates at least in the needle beds remote from a knitware take-off.

The double-headed tongue needles enable patterning to be carried out with the aid of the cam means, and they obviate the need for specially controlled pressure plates.

Knitting machines having two oppositely disposed needle beds disposed in one and the same plane are known as evidenced by German Patent Specification No. 702 370, the double-headed needles of these machines being formed as double-headed tongue needles, and transfer plates being provided in each of the needle beds. However, in these machines the transfer plates only serve the purpose of enabling transferring to be carried out between adjacent needles so as to form the pattern, but the transfer plates in a knitting machine in accordance with the invention are provided for producing circular goods, since, when the double-headed tongue needles are each moved into the opposite needle bed, the stitches have to be moved from the shaft into the already opened hook, and this is achieved with the aid of the transfer plates.

In contrast with a known double V-bed knitting machine, the double flat-bed knitting machine of the present invention possesses the advantages of the greater simplicity attached to the nested flat-bed knitters.

BRIEF DESCRIPTION OF THE DRAWINGS

A preferred example of the invention will now be described in greater detail by reference to the attached drawings in which.

Figure 8:
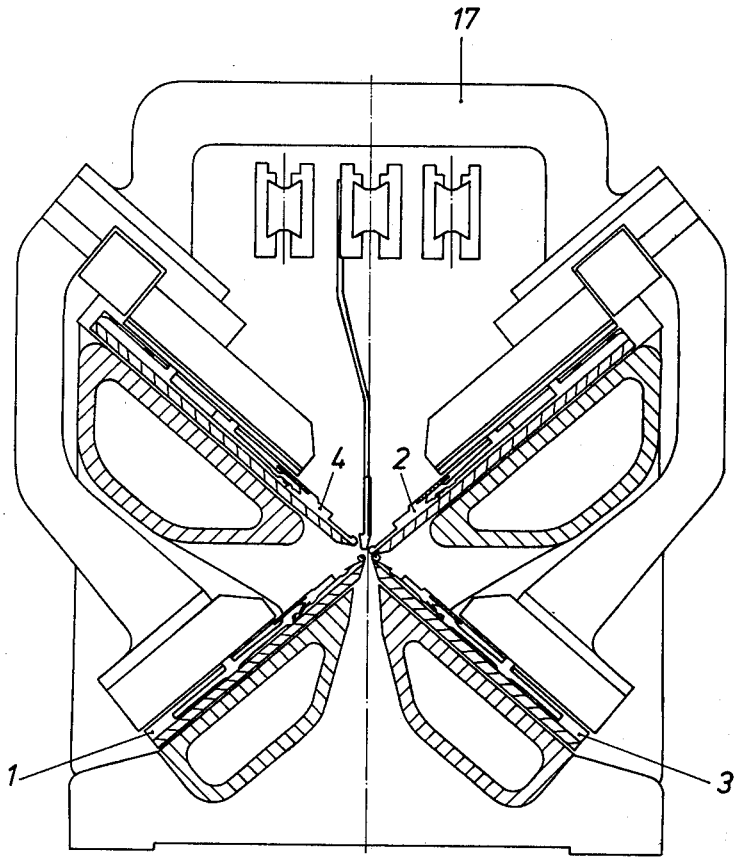
Figure 9:
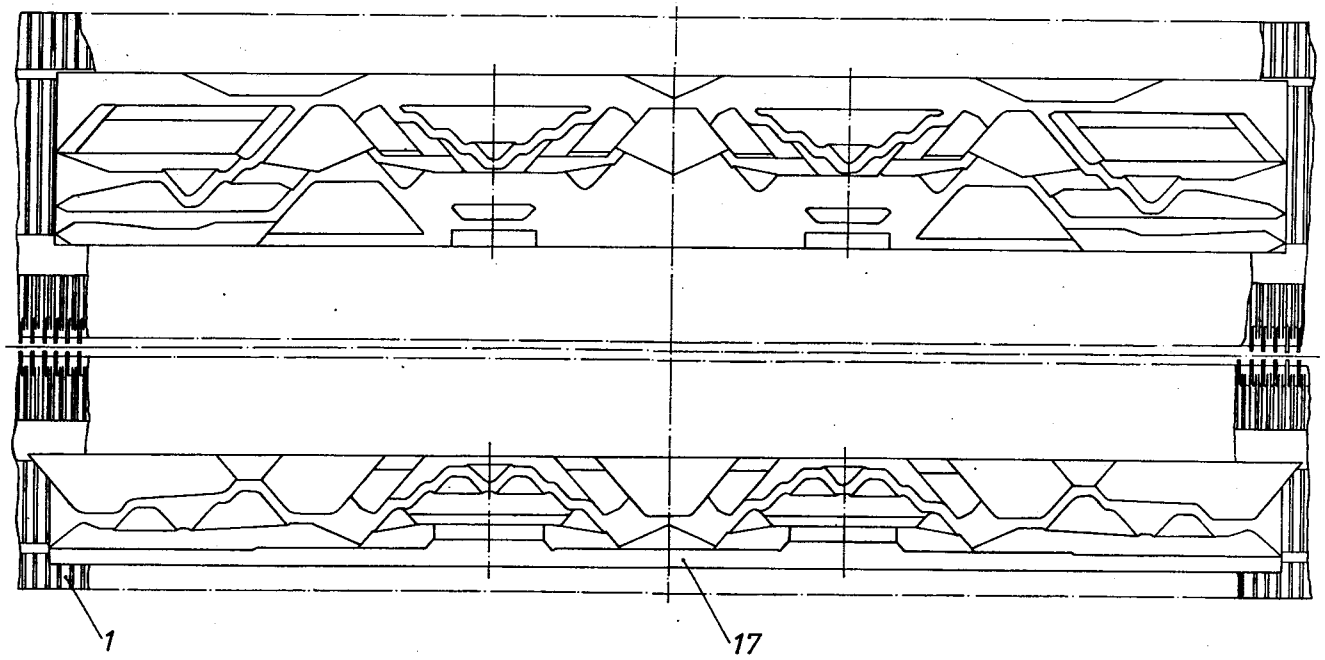
Figure 15:
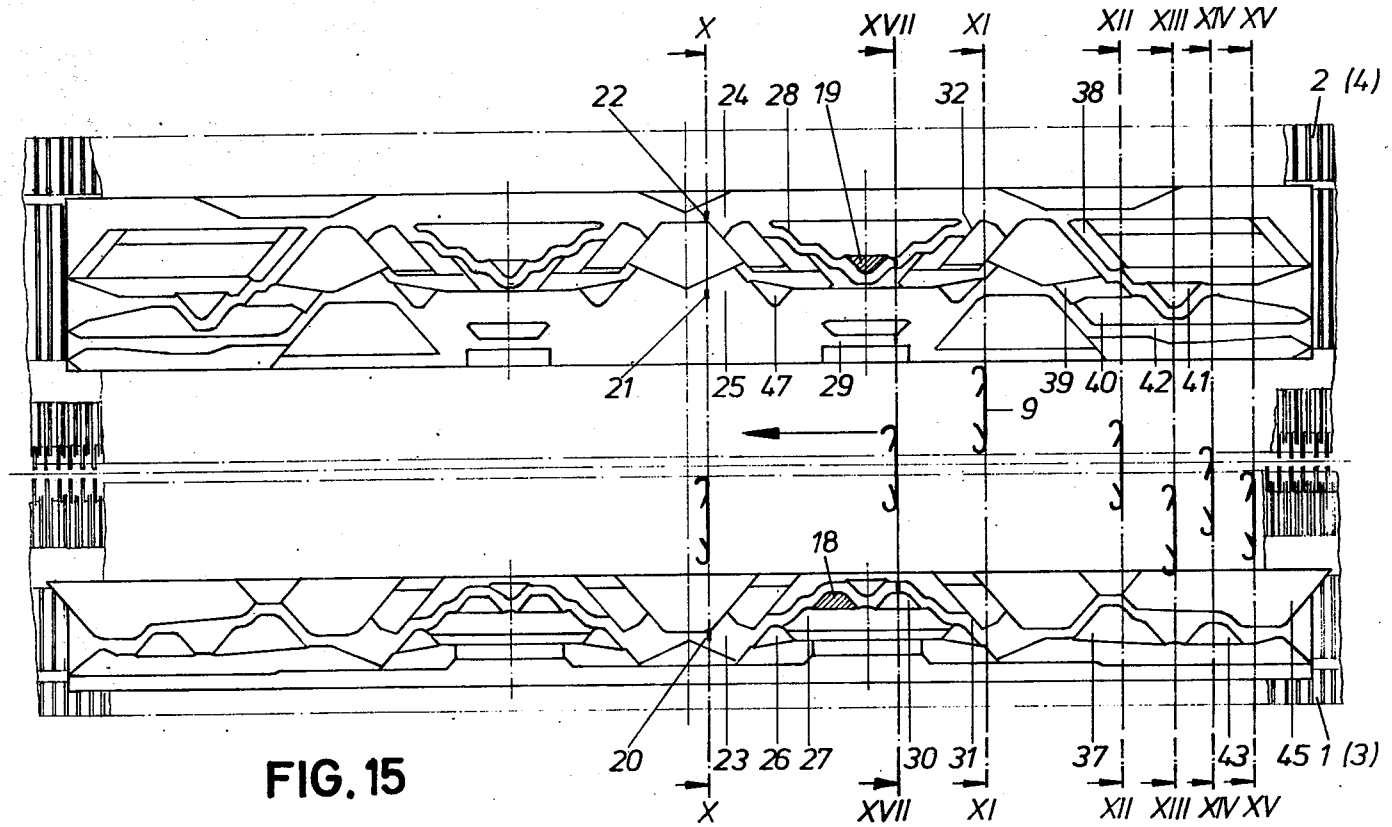
Figure 16:
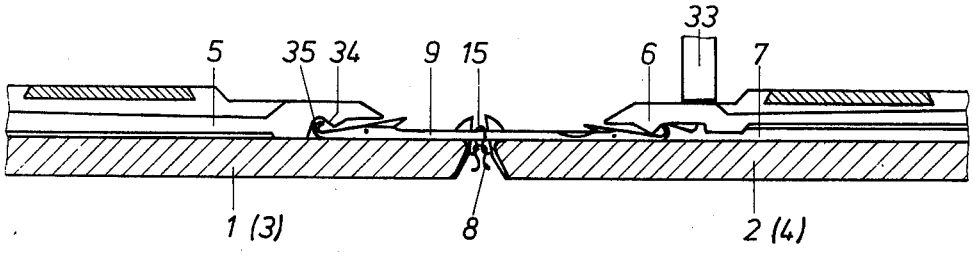
Figure 17:
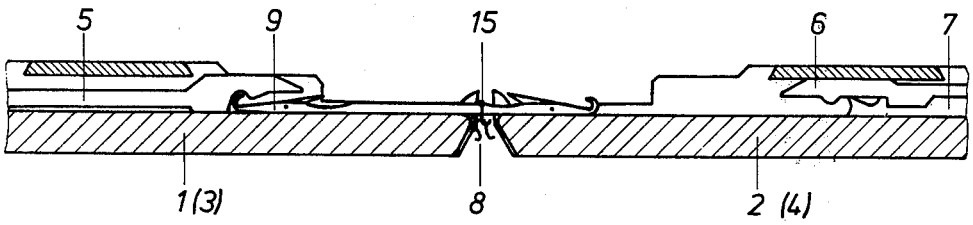

FIGS. *6a* to *6f* is a diagrammatic illustrations of the mode of operation when producing a right/right knitted circular product;

FIGS. *7a* to *7g* is a diagrammatic illustrations of the mode of operation when producing a left/left circular knitted product;

FIG. 8 is a cross-sectional view of the needle beds and slides of a knitting machine embodying the invention, FIG. 9 is a side view of part of the needle beds and double-cam arrangement of FIG. 8, as seen from the right in FIG. 8;

FIGS. 10–14 are partial sectional views through an opposed pair of needle beds showing a knitting sequence;

FIG. 15 is a plan view, partly in section of a needle bed and cam arrangement; and FIGS. 16 and 17 are partial sectional views through an opposed pair of needle beds showing a knitting sequence.

DETAILED DESCRIPTION OF THE INVENTION

Figure 1:
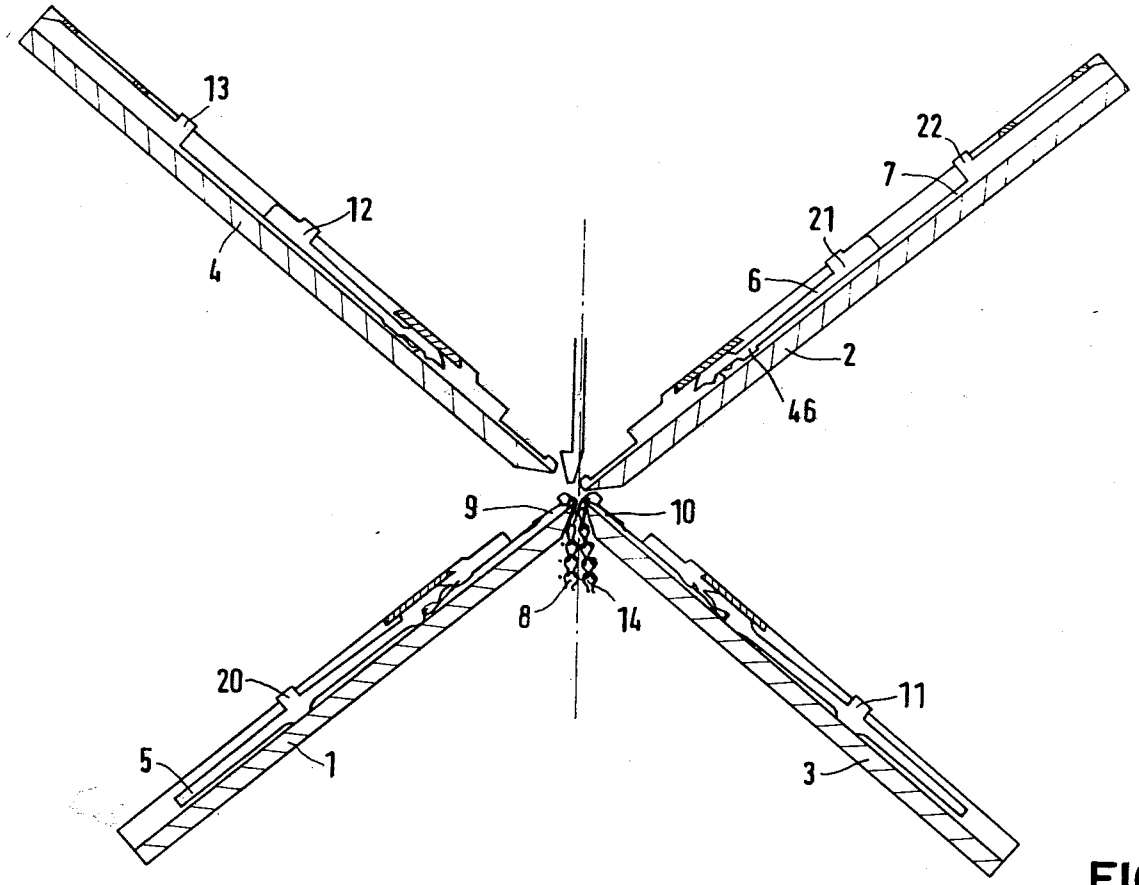
FIG. 1 is a diagrammatic cross-sectional view of the four needle beds of the preferred knitting machine in accordance with the invention.

FIG. 1 shows a knitting machine known as a double flat-bed knitting machine which includes four needle beds 1, 2, 3 and 4 (N.B. 1, N.B. 2, N.B. 3 and N.B. 4). The needle beds 1 and 2 are disposed in one plane and the needle beds 3 and 4 in another plane which intersects the first. The needle beds 1 and 2, and the needle beds 3 and 4 constitute the two pairs of needle beds of a flat-bed knitting machine and the needle beds 1 and 3 together form the pair of needle beds of a V-bed knitting machine. The needle beds 1 and 2 are fitted with left-hand needles 9, and the needle beds 3 and 4 with left-hand needles 10. The lower needle beds 1 and 3 have needle plates 5 and 11 and the upper needle beds 2 and 4 are provided with needle plates 6 and 12 as well as transfer plates 7 and 13.

The knitting machine embodying the invention can be regarded as a combination of straight and circular knitting machines by means of which it is possible to produce two-ply flat-bed circular cross-knitted goods. Examples of a number of patterns that can be knitted will now be described.

Figure 6:
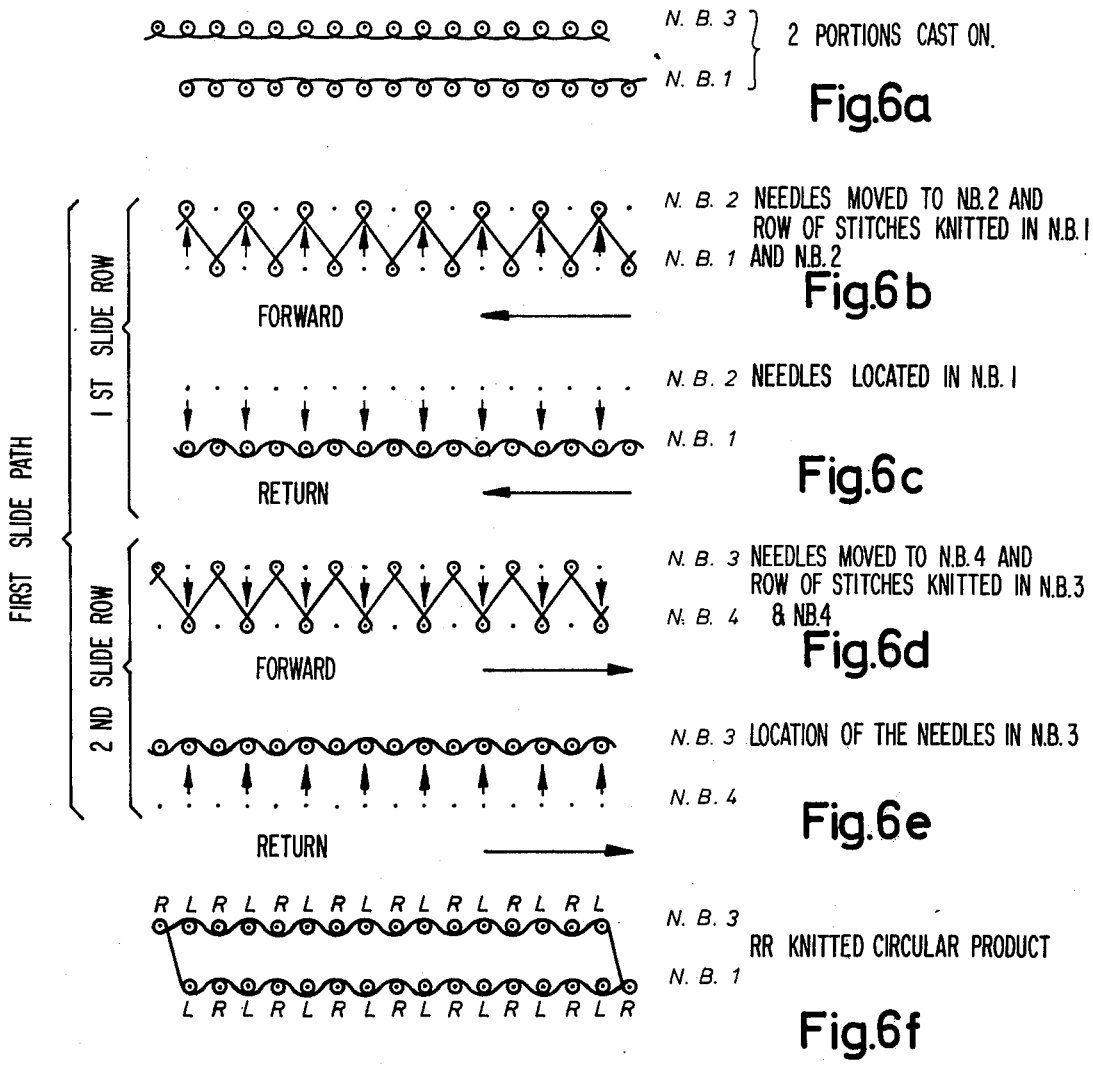

FIG. 6 in conjunction with FIGS. 1 to 5, explain the mode of operation of the knitting machine when producing a right/right knitted circular piece. In producing a knit of this kind, two portions 8 and 14 are first cast onto the needles 9 and 10 of the needle beds 1 and 3 as shown in FIG. 1 and diagrammatically illustrated in FIG. *6a*. Each of the left-handed needles 9 and 10 receives a stitch. The slide, not illustrated, is located at the right for example, and the needle bed 4 will have been previously retracted into the position shown in FIGS. 1 to 5 during travel of the slide to the right.

Figure 2:
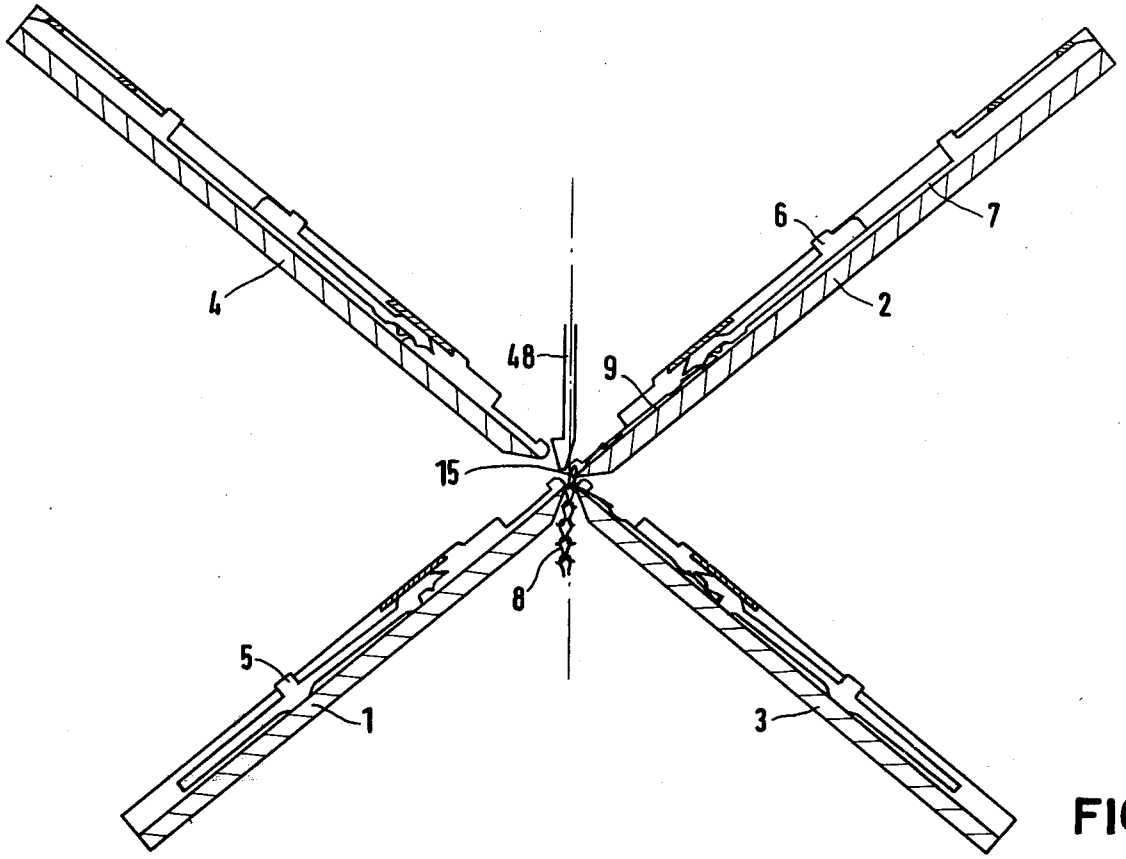
FIGS. 2 to 5 are cross-sectional views of the needle beds, similar to that of FIG. 1, and illustrating different stages in the formation of a right/right knit in a circular knitted product.

The slide is then moved from the right to left. As this happens the first, third, fifth, etc. of the left-hand needles 9 are moved in the customary manner from the needle bed 1 into the needle bed 2 by the needle plates 5 and 6 and the cams shown in FIGS. 9 and 15. FIG. 2 shows the position after these left-hand needles 9 have been shifted. At the same time the second, fourth, sixth, etc. left-hand needles 9 in the needle bed 1 are pushed out over the engagement distance and are retracted into the needle bed 1 again. During these needle movements, the filaments are inserted into the left-hand needles 9 at specific points so that stitches 15 and 16 are formed on both needle beds 1 and 2. This is illustrated diagrammatically in FIG. 6*b*.

Figure 3:
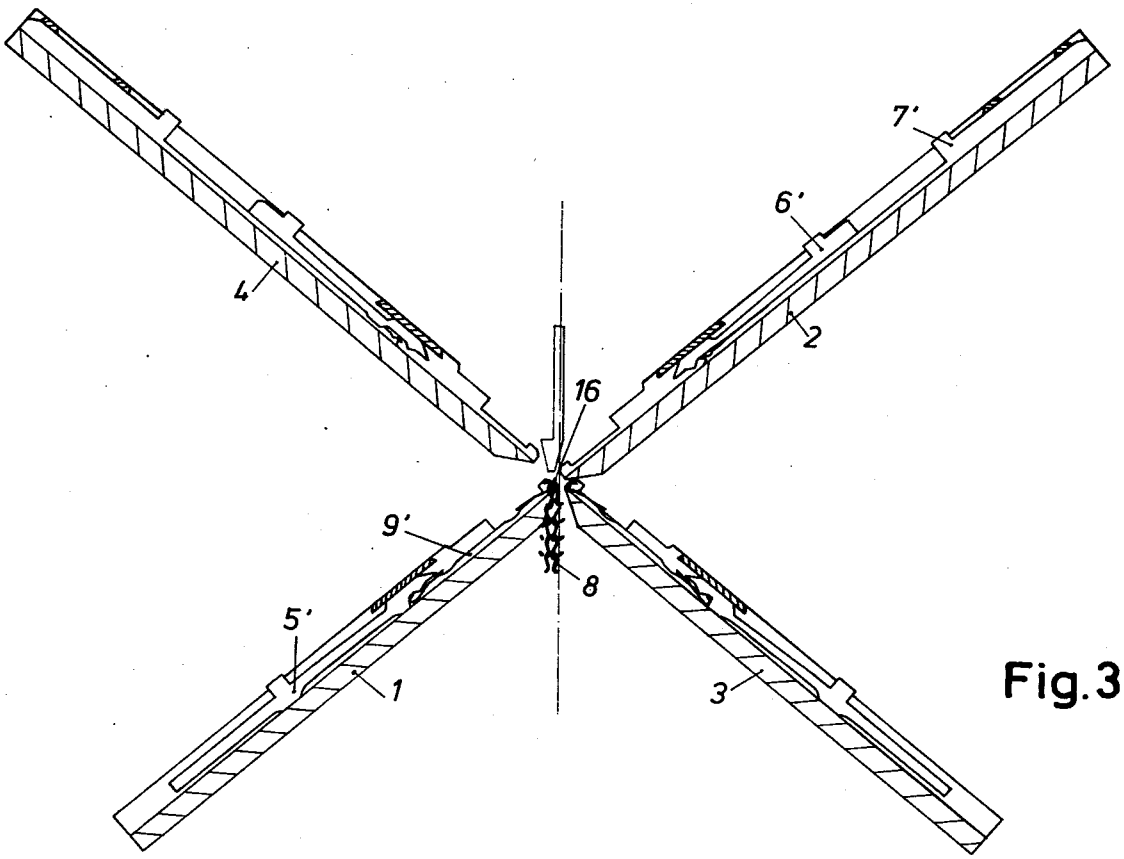

Casting-on in the needle bed 2 is illustrated in FIG. 2, and casting-on in the needle bed 1 is illustrated in FIG. 3, and the left-hand needle 9', the needle plates 5' and 6' and the transfer plates 7', shown in FIG. 3, are each time located in the adjacent left-hand or right-hand channel of the left-hand needle 9 in FIGS. 1, 2, 4 and 5.

Figure 4:
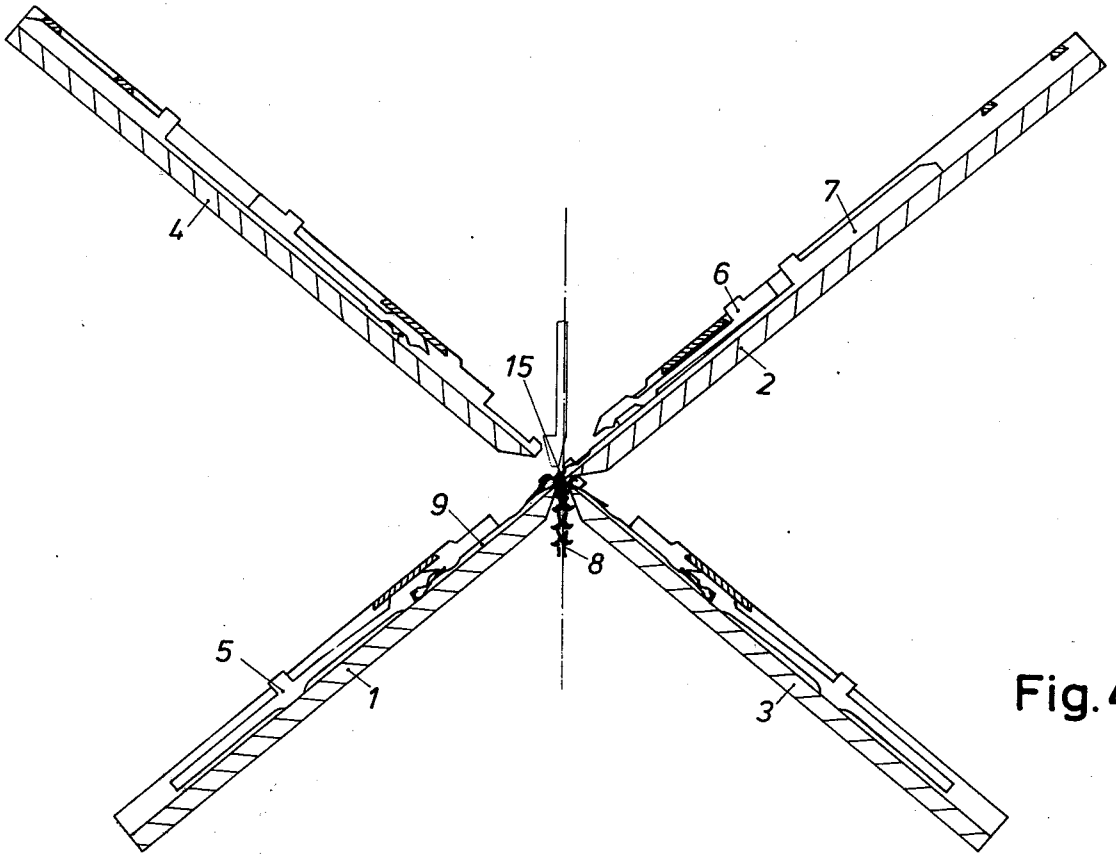
Figure 5:
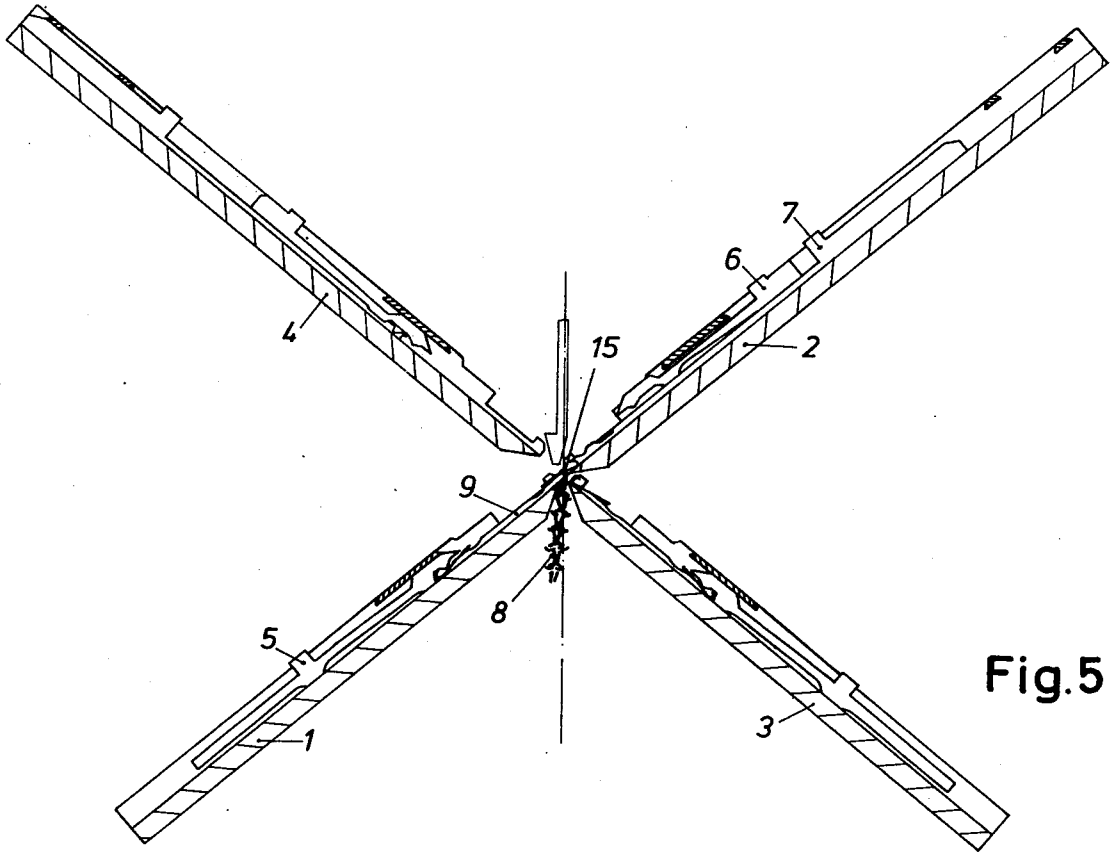

During travel of the slide to the left, the left-hand needles 9 are again extended out of the needle bed 2 and back into the needle bed 1, and the transfer plate 7 receives the stitch 15 that falls from its needle, as illustrated in FIG. 4. Thereupon the stitch 15 is immediately passed to the left-hand needle 9 by further advance of this needle by the transfer plate 7, this stage being shown in FIG. 5.

Before the slide leaves the needles, the latter are brought into register by the cams. All the left-hand needles together with their stitches are then located in the needle bed 1. Left-hand stitches are suspended from each first, third, fifth, etc. left-hand needle 9, and right-hand stitches from each second, fourth, sixth, etc. left-hand needle 9, as shown in FIG. 6*a*.

The slide occupies the left-hand position. The needle bed 2 is retracted and the needle bed 4 is brought into its "basic " position. The slide is then moved from left to right. As this happens, the left-hand needles 10, the needle plates 11 and 12 and the transfer plates 13 of the needle beds 3 and 4 cooperate in the same manner as described above in connection with the needle beds 1 and 2. FIGS. 6*d* and 6*e* are the corresponding needle and stitch diagrams for the left-hand needles 10 of the needle beds 3 and 4.

Finally, FIG. 6*f* shows the path taken by the threads in the needle beds 1 and 3, this Figure illustrating the right/right circular knit after completion of the cycle stroke of the slide.

Figure 7:
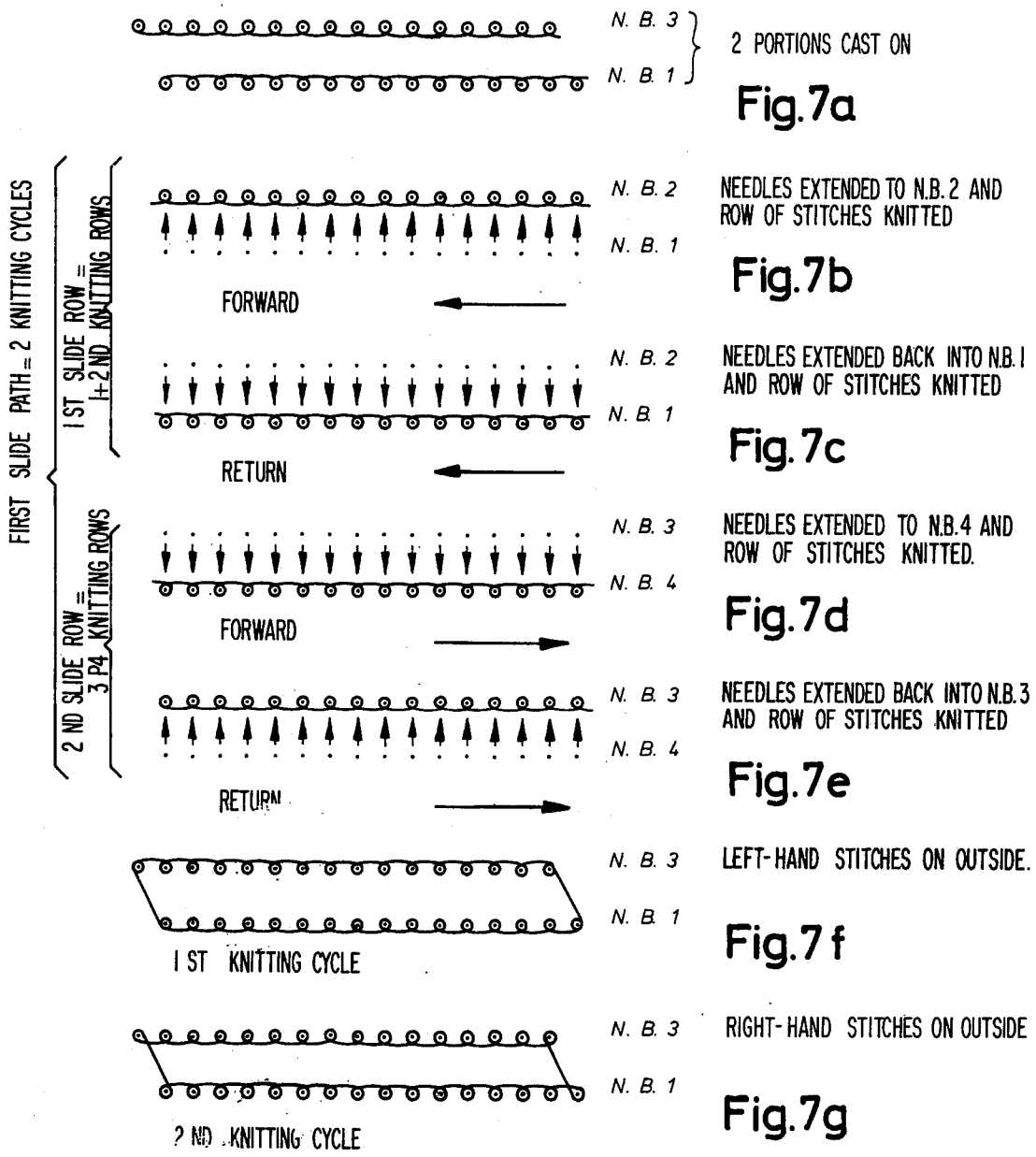

FIG. 7 shows the mode of operation when producing a left/left circular knit. As shown in FIGS. 1 and 7*a*, two portions 8 and 14 of material are cast onto the left-hand needles 9 and 10 the needle beds 1 and 3. The needle bed 4 is retracted. Each of the needles 9 and 10 carries a stitch. The slide is in the right-hand position, for example.

The slide is now moved to the left. While this is happening, all the left-hand needles 9 are led from the needle bed 1 to the needle bed 2. During movement of the needles the thread is presented to the left-hand needles 9 at the corresponding point, and a row of stitches is thus knitted on the needle bed 2, as illustrated in detail in FIGS. 2 and 7*b*. During the same travel of the slide, all the left-hand needles 9 are extended from the needle bed 2 into the needle bed 1, and a second row of stitches is knitted by means of a second thread insertion, but this time in the needle bed 1 as illustrated in FIG. 7*c*.

The needle bed 4 is then brought into the "basic" position and the needle bed 2 is retracted, whereupon the slide is moved from left to right. As this takes place all the left-hand needles 10 are extended from the needle bed 3 into the needle bed 4. During the movement of the needles, the thread is presented to the left-hand needles 10 at the corresponding point, and a row of stitches is thus formed on the needle bed 4, as shown in FIG. 7*d*. During the same movement of the slide, all of the left-hand needles 10 are again extended back into the needle bed 3 so that a second row of stitches is formed by means of a second thread insert, as illustrated in FIG. 7*e*.

FIG.7*f* shows the stitch diagram after completion of the first knitting cycle, in which, left-hand stitches, as seen from the exterior, can be observed. FIG. 7*g* on the other hand shows the stitch diagram after completion of the second knitting cycle. in which right-hand stitches can be seen throughout on the outside. The constant alternation between left-hand and right-hand rows of stitches gives the non-patterned or plain left/left product. To enable knitting to be carried out to any required pattern, mechanical, electro-magnetic or electronic needle-selection devices, not illustrated, are used. FIG. 8 is a cross-sectional view of the needle beds 1, 2, 3 and 4 together with a slide 17 shown schematically. Finally, FIG. 9 is a side view of a portion of the needle beds and the slide as seen in FIG. 1 and a double cam can be seen on the slide 17. The double cam enables the capacity of the straight and circular knitting machine of the invention to be increased for certain knits, for example, in producing a circular right/right knit. Using a double cam and the arrangement shown in FIG. 6*b*, the first, third, fifth, etc. left-hand needles 9 are extended from the needle bed 1 to the needle bed 2 while knitting proceeds at the same time, and a second knitting operation takes place in the same slide cycle. Then, as shown in FIG. 6*c*, the left-hand needles 9 are again collected in the needle bed 1. After the slide cycle has been completed, two right/right circular runs are knitted instead of one, as shown in FIG. 6*f*.

When a circular knitted piece is knitted on the knitter shown, the diamter of the circular piece can be adjusted by varying the working width by appropriate selection of the needles or needle plates.

The foregoing knitting steps which were explained with reference to the schematic diagrams of FIGS. 6 and 7 will now be explained in more specific detail by reference to the sequential needle position views of FIGS. 10–14, 16 and 17 and the detailed view of the operating cams in FIG. 15.

Figure 10:
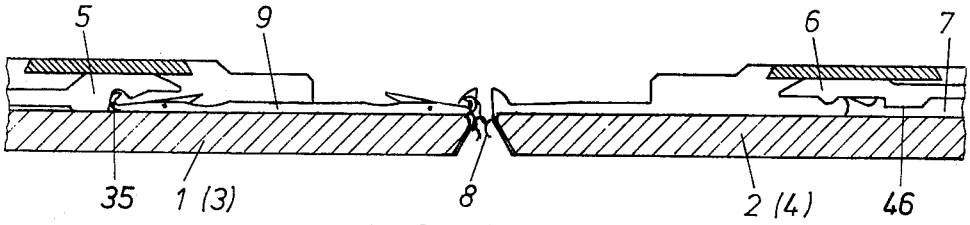
Figure 11:
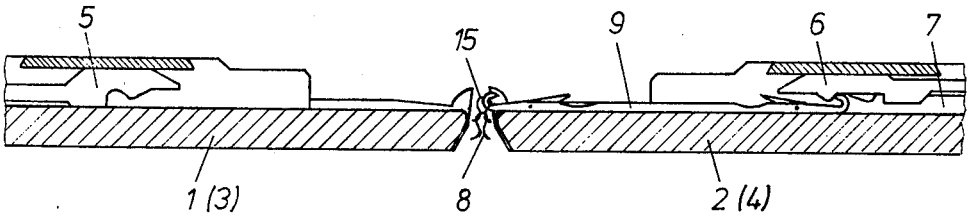
Figure 12:
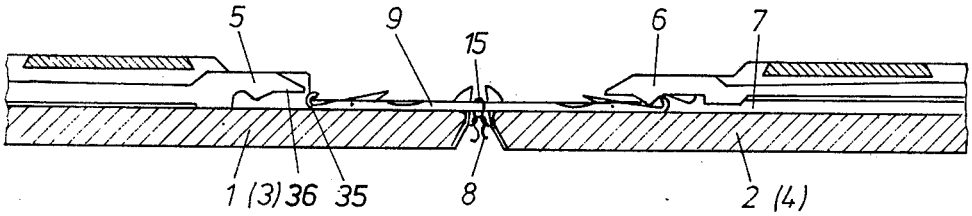
Figure 13:
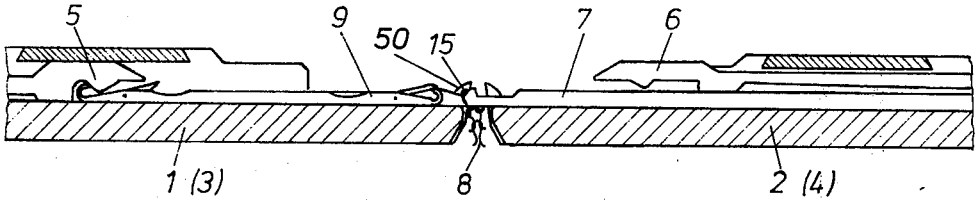
Figure 14:
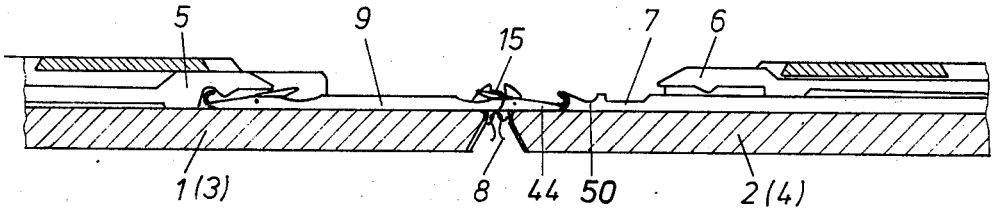

According to FIG. 10 the last stitch of the knitting 8 is suspended on the needle 9. The knitting plate 5 is engaged into the left-hand needle hook 35, whereas the plate 6 and the transfer plate 7 in the needle bed 2 are in waiting position. The feet 20,21,22 (FIG. 1) of the knitting plates 5 and 6, and the transfer plate 7 respectively, are positioned in the cam channels 23,24,25, respectively. (FIG. 15, Section X) at this moment.

The knitting and transfer plates 5, 6 and 7 have high or low feet and are inserted into the needle beds 1 and 2 in a ratio 1:1, FIG. 6*b*. During the run of the carriage to the left, the feet 20 slide up on the cam members 26, 27 and the high feet 21, 22, i.e., of each second knitting and transfer plate 6 and 7, slide up on the half-active cam 48 and the cam 28. The knitting plate 6 is connected with the transfer plate 7 at the coupling position 46, FIG. 10. Both plates necessarily carry out the movement, regardless of whether this movement is caused by foot 21 or by the foot 22. First, the high knitting plate foot 21 is driven out by the half-active cam 47. During this upward movement, the transfer plate foot 22 is led into the cam channel to the cam 28. From there, the foot 22 takes over the further driving out and leads the foot 21 to the channel 29. The cams 18 and 19 are out of action and the cam 30 is half in action.

In the further course of procedure, the cam 30 drives out the knitting plate 5 with high foot and the associated needle 9 until the needle 9 is positioned in the middle of the front needle bed 1 and rear needle bed 2, FIGS. 16 and 15, Section XVII. In this position, the knitting plate 6 with high foot is engaged into the right needle hook. During this procedure, the knitting plate 5 with low foot is not actuated by the cam member 30; it remains in the closed position, FIG. 17, in which the stitch 15 comes to rest behind the tongue.

When the carriage moves further to the left, the knitting plate 6 with high foot is drawn off by the cam 32 and the knitting plate 5 with high and low foot is drawn off by the cam 31. A holding down member 33 secured to the carriage is provided over the plate 6 and hinders a decoupling of the knitting plate 6 from the needle 9. The needle 9 is now drawn into the needle bed 2 by the knitting plate 6 with high foot and the knitting plate 5 with high foot without needle as well as the knitting plate 5 with low foot with needle 9 are drawn into the needle bed 1. During this action the knitting plate 5 with high foot with an inclination 34 slides over the needle hook 35 and releases the needle 9. The plates and the needles are moved into the position shown in FIGS. 10, 11, 15, Section XI and FIGS. 1, 2 and 6*b*.

Before the lowest point of withdrawal was reached, the yarn guide means 48 inserted the yearn into the needle hook as shown in FIG. 2. The old stitches 15 slide over the needle hooks closed by the latches and form new stitches together with the placed yearn on the needle beds 1 and 2.

During the same carriage run the needles are now in a trailing manner accumulated in the needle bed 1. The needle 9 from the needle bed 2, FIG. 11, must be brought into the needle bed 1, without forming a new stitch and without the old stitch being cast off from the needle 9. The knitting plate 6 with the coupled transfer plate and the needle 9, FIG. 12, together with the knitting plate 5 with high foot are driven out by the cams 37,38,39 and 40, which are half in action (FIG. 15, Section XII) to the extent shown in FIG. 12. The needle 9 is positioned in the middle of the two needle beds and with its left hook 35 in front of the point 36 of the knitting plate 5 with high foot.

During further carriage run to the left, the transfer plate 7 is pushed further forward by the cam 41. The knitting plate 6 is held with its foot 21 in the cam channel 42 and decoupled from the transfer plate 7. The transfer plate 7 pushes the needle 9 into the needle bed 1 until it engages into the knitting plate 5 with high foot and is pushed with same even further, namely, until the stitch 15 suspended on the needle 9 slides over the right needle head into the transfer plate notch 50, FIGS. 13 and 15, Section XIII. Subsequently, the knitting plate 5 with high foot is driven out by the cam 43, which is half in section. It pushes the needle 9 and the transfer plate 7 into the needle bed 2 until the stitch 15 slides out of the notch 50 and into the needle hook 44, FIGS. 14 and 15, Section XIV. The cam 45 brings the knitting plate 5 and the needle 9 back into the basic position of FIG. 10.

All the needles and the newly formed right and left stitches are now located in the front needle bed 1, FIG. 6*c*.

During movement of the carriage from left to right the phases and actions are performed but with the needles 10 and the knitting and transfer plates 11, 12, 13 in the needle beds 3 and 4.

While a preferred embodiment of the invention has been particularly described by way of example, it is to be understood that variations and modifications may be made within the scope of the following claims.

What is claimed is:

1. A double flat-bed knitting machine comprising four needle beds disposed in two mutually opposed pairs, a plurality of needles associated with each pair of needle beds, slide means carrying cam means for actuating said needles in the needle beds, each pair of needle beds being disposed in one of two mutually bisecting planes respectively, each of said needles having a hook and tongue at each end, associated plate means for moving said needles, and transfer plates disposed at least in the needle beds remote from the location of the knitware take-off.

2. A double flat-bed knitting machine as set forth in claim 1 wherein said cam means for each of said needle beds are carried by a single slide for simultaneous movement relative to said four needle beds.

3. A double flat-bed knitting meachine as set forth in claim 2 wherein said cam means for each needled bed are disposed in a double cam arrangement.

* * * * *